US008403328B2

(12) United States Patent
Vandoren

(10) Patent No.: US 8,403,328 B2
(45) Date of Patent: Mar. 26, 2013

(54) GAME BOARD AND ACCOMPANYING GAME PIECES

(76) Inventor: Rolf Vandoren, Kontich (BE)

( * ) Notice: Subject to any disclaimer, the term of this patent is extended or adjusted under 35 U.S.C. 154(b) by 0 days.

(21) Appl. No.: 13/147,656

(22) PCT Filed: Feb. 3, 2010

(86) PCT No.: PCT/BE2010/000007

§ 371 (c)(1),
(2), (4) Date: Aug. 3, 2011

(87) PCT Pub. No.: WO2010/088743

PCT Pub. Date: Aug. 12, 2010

(65) Prior Publication Data

US 2011/0291360 A1 Dec. 1, 2011

(30) Foreign Application Priority Data

Feb. 4, 2009 (BE) ..... 2009/0060

(51) Int. Cl.
*A63F 3/00* (2006.01)

(52) U.S. Cl. ..... 273/287; 273/241

(58) Field of Classification Search ..... 273/239, 273/241, 275, 282.1, 282.3, 287
See application file for complete search history.

(56) References Cited

U.S. PATENT DOCUMENTS

| | | | | |
|---|---|---|---|---|
| 287,352 | A * | 10/1883 | Ward | 273/153 S |
| 2,757,934 | A * | 8/1956 | Dunbar | 273/272 |
| 2,863,666 | A * | 12/1958 | Aronson | 273/108 |
| 3,929,337 | A * | 12/1975 | Hayes | 273/243 |
| 4,257,609 | A * | 3/1981 | Squibbs | 273/241 |
| 4,620,709 | A | 11/1986 | Palladino, Jr. | |
| 5,716,284 | A * | 2/1998 | Maldonado | 473/5 |
| 6,386,539 | B1 * | 5/2002 | Deskovick | 273/153 J |
| 7,040,621 | B2 * | 5/2006 | Cheng | 273/160 |
| 8,020,868 | B1 * | 9/2011 | Velte | 273/239 |
| 2008/0227510 | A1 * | 9/2008 | McLaughlin | 463/9 |

FOREIGN PATENT DOCUMENTS

| | | |
|---|---|---|
| FR | 423593 | 4/1911 |
| FR | 2706783 | 12/1994 |
| FR | 2806002 | 9/2001 |
| NL | 1032812 | 5/2003 |

OTHER PUBLICATIONS

International Search Report in PCT/BE2010/000007, Jun. 22, 2010.

* cited by examiner

*Primary Examiner* — Vishu K. Mendiratta

(74) *Attorney, Agent, or Firm* — Bacon & Thomas, PLLC

(57) ABSTRACT

Game board having a wavy relief structure formed of a series of rises and dips extending at regular distances from one another in at least two different directions and whereby one or several game pieces are further formed as sliding pieces with one block or with several blocks which are connected to one another and whereby the lower contact surface of every block has a sloping shape which is predominantly complementary to the shape of the dips of the game board.

21 Claims, 10 Drawing Sheets

GAME BOARD AND ACCOMPANYING GAME PIECES

FIELD OF THE INVENTION

The present invention concerns a new type of a game board and the accompanying game pieces.

SUMMARY OF THE DESCRIPTION

The invention in particular concerns a game board with a wavy relief formed of a series of rises and dips extending at regular distances from one another in at least two different directions, and further one or several game pieces in the shape of sliding pieces which are each formed of a single block or several blocks which are connected to one another and whereby the lower contact surface of each block has a sloping shape which is predominantly complementary to the shape of the dips in the game board, whereby every sliding piece can be moved in at least one of the aforesaid directions over the game board between two arbitrary fixed positions of rest, whereby in every position of rest the sliding piece extends in one or several dips of the game board, whereas any rotation or sliding movement in another direction than the one mentioned above is prevented or hindered.

Thanks to the shape of the game board, deepened tracks are formed extending in the aforesaid directions between the parallel rows of rises.

Thus, the blocks of the sliding pieces and consequently also the sliding pieces themselves can be easily moved by hand in said deepened tracks, but any shift in another direction or a rotation is made difficult or prevented as the blocks of the sliding pieces should then be moved over the rises of the game board.

Thanks to the wavy structure, the sliding pieces can thus be easily moved by hand from one position of rest into another position of rest, whereby the sloping wave structure makes sure that, by moving the sliding pieces in one of the above-mentioned directions, they are slightly lifted out of their position of rest to subsequently drop in a new position of rest after the top position has been transgressed.

The positions of rest are thus clearly defined and the sliding pieces cannot be easily moved out of their positions of rest by an accidental or unintentional movement.

An appropriate shape for the relief structure is the one whereby the relief evolves sinusoidally or more or less sinusoidally in the aforesaid directions, although other sloping shapes are not excluded.

According to a preferred embodiment, the blocks of every sliding piece are provided with a protrusion on their contact surface, directed towards the game board, and continuous grooves are provided in the game board extending in the aforesaid directions in the game board and connecting the dips of the game board so as to form a guide for the aforesaid protrusions.

These grooves provide for an even better guide of the sliding pieces in the aforesaid directions.

Optionally, the rises of the game board may be provided with a mark at the top so as to simplify the visualisation of fields formed in the grid.

The sliding directions may be orthogonal directions, but they can also be directions running parallel for example to the directions of an equilateral triangle.

This type of game board is appropriate for any possible game whereby pieces must be moved according to predetermined positions of rest, but it is also interesting to compose puzzles and any other type of brain twisters with whereby use can be made of sliding pieces with several blocks which are connected in such a way that the centre distance between two adjoining blocks is either equal to the orthogonal centre distance between two successive dips in one of the aforesaid orthogonal directions, or is equal to the diagonal centre distance between two successive dips in the diagonal direction and is thus separated by a top of the game board.

In this manner, also different shapes and combinations of sliding pieces are possible whereby the blocks of a sliding piece can be connected two by two and whereby the connections between blocks with an equal centre distance are parallel to one another or are at right angles to one another, and the connections between blocks having a different centre distance enclose an angle of 45° or 135°.

When in rest, such sliding pieces extend over several dips, whereby pairs of blocks with an orthogonal centre distance can only extend in one of the aforesaid directions, whereas pairs of blocks with a diagonal centre distance can only extend in a diagonal direction.

Also combinations of such pairs of blocks with an orthogonal or a diagonal centre distance are possible whereby sliding pieces can then be formed having a longitudinal shape or a angular of hooked shape, whereby the legs formed between the blocks by the connections can be at right angles or at an angle of 45° or 135°.

The multitude of shapes of the sliding pieces and the many possible mutual positions allow for many game patterns and strategies.

Connections between blocks situated at a diagonal distance from one another may be provided with lateral recesses in view of a fitting lateral connection to a block of an adjacent sliding piece. This makes it possible to move several sliding pieces simultaneously in one direction by moving a single sliding piece.

Even more game variations become possible if the sliding pieces can be provided with mutually distinguishing characteristics, such as a different colour, texture or the like, whereby sliding pieces with a specific distinguishing characteristic can be assigned to a particular player or may be accorded a specific function in the game.

According to a variant, the game board may be translucent or partly translucent, for example by making use of transparent material or as the relief structure is formed of an open structure of for example parallel game piece situated at a distance from one another.

This offers the advantage that it is possible to figure out patterns for the sliding pieces beforehand, which are then drawn in advance on an underlying sheet which is put under the game board so as to position the corresponding sliding pieces according to the pattern which is visible through the board.

An additional characteristic may consist in that the game board is provided with a standing edge, for example along the perimeter or a part thereof, and in that at least one exit is provided in the edge via which a sliding piece can be slidingly removed from the game board.

A playing method might thus consist in that a certain virus, simulated by a particular sliding piece, must be removed from the game board by one or several players via the aforesaid one or several exits of the game board by strategically moving said and/or other sliding pieces.

The level of difficulty of the board game may be raised if need be or, on the contrary, made easier by providing one or several obstruction pieces which may form a local obstacle to the movement of the sliding pieces and which consist of one or several blocks whose shape is analogous to that of the sliding pieces, but whereby the contact surface of at least one block is provided with a cross-shaped rib at the bottom, directed towards the game board, which can be held in two crossing grooves of the game board.

Said obstruction pieces may be provided with a distinguishing shape, colour or structure at the top for visual recognition.

The sliding movement of certain sliding pieces may possibly be restricted in any of the aforesaid directions by providing the contact surface of the sliding piece with one or several parallel ribs so as to guide it in the grooves of the board, parallel to said ribs.

DESCRIPTION OF THE DRAWINGS

In order to better explain the characteristics of the invention, the following preferred embodiments of a game board according to the invention are described by way of example only without being limitative in any way, with reference to the accompanying drawings, in which.

DETAILED DESCRIPTION OF PREFERRED EMBODIMENTS OF THE INVENTION

Figure 1:
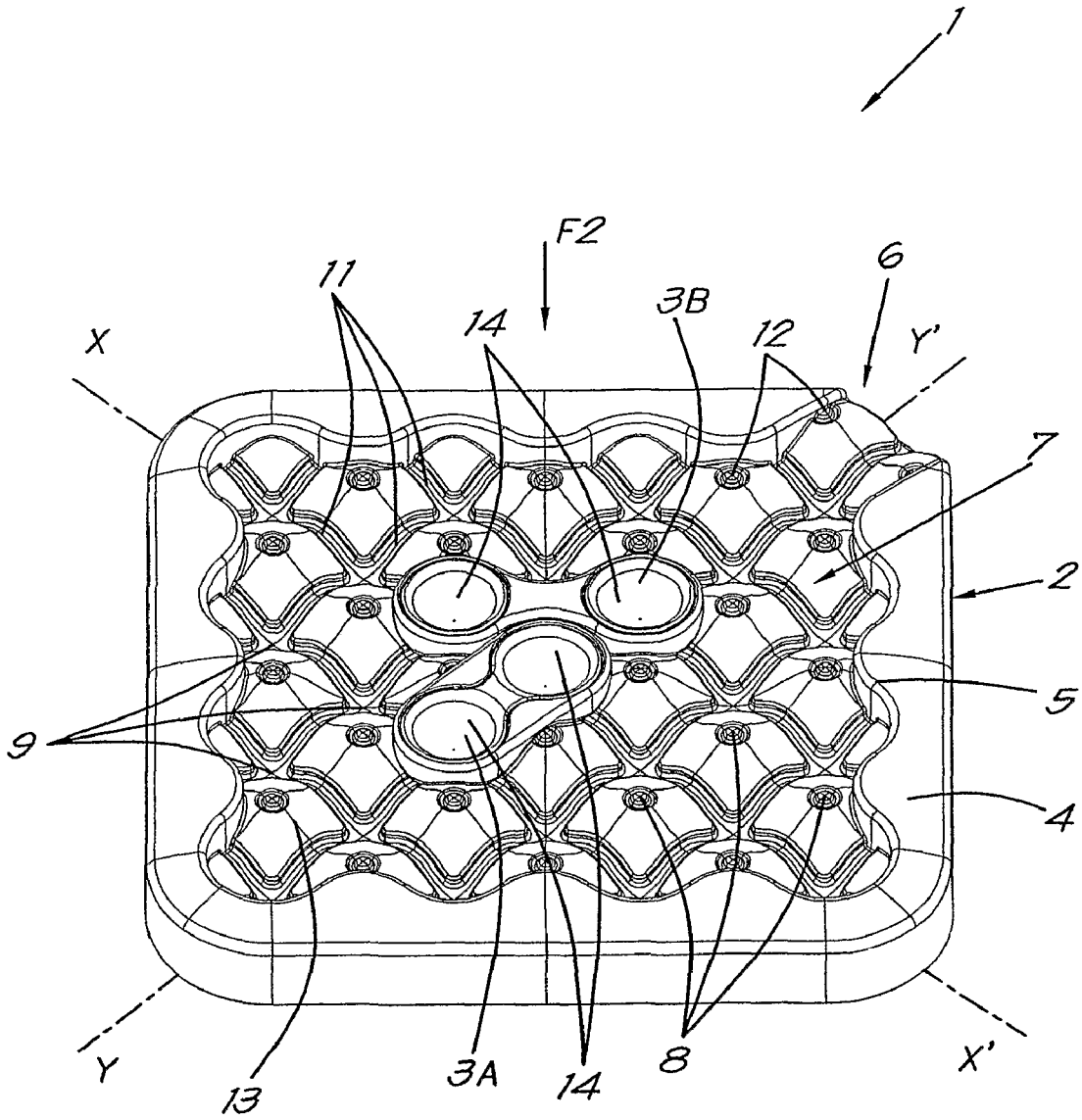
FIG. 1 schematically shows a game board and game pieces according to the invention, seen in perspective.

FIGS. 1 to 8 represent a game 1 consisting of a square game board 2 with two sliding pieces on it, 3A and 3B respectively.

The game board 2 is in this case made with standing edges 4 having a wavy pattern along the inner perimeter 5 and an opening 6 which is in this case situated in a corner of the game board 2 and which serves as an exit for one or several sliding pieces 3 which can be moved over the game board 2.

According to the invention, the game board 2 has a wavy relief structure 7 formed of a series of rises 8 and dips 9 extending at regular distances from one another in at least two different orthogonal directions, X-X' and Y-Y' respectively, which extend at an angle of 45° in relation to the edges 4 of the game board 2 in the given example, but which alternatively could also run parallel to said edges 4.

Figure 3:
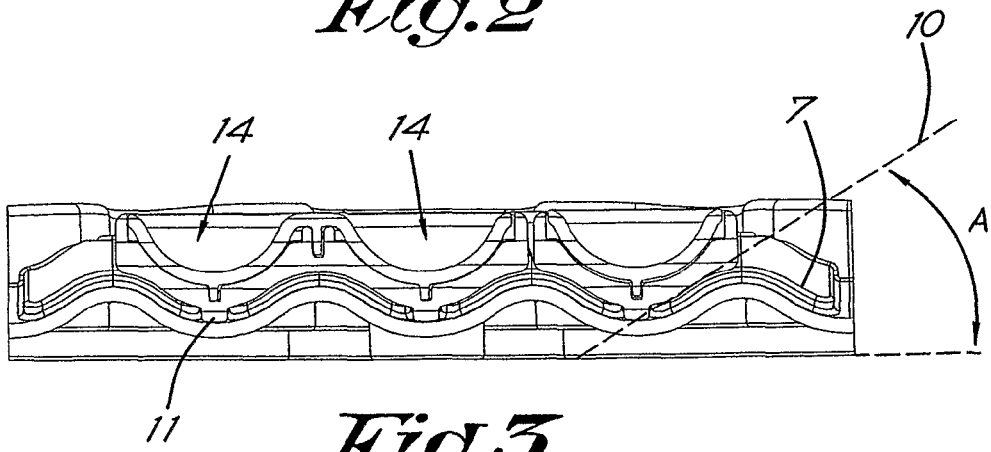
FIGS. 3 and 4 represent a section according to lines III-III and IV-IV respectively in FIG. 2 to a larger scale.
Figure 4:
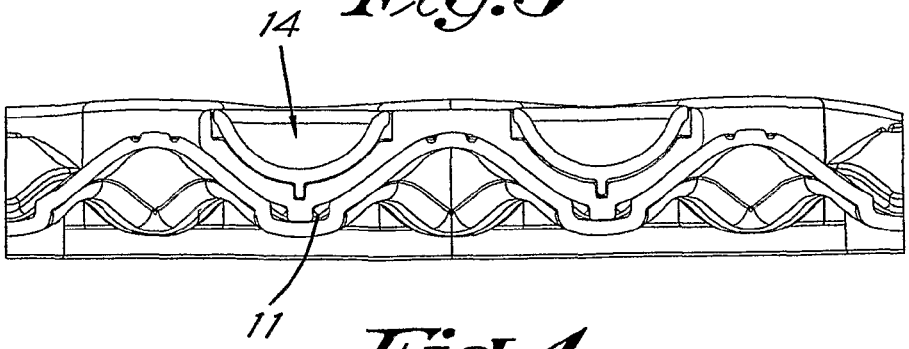

In the sections according to FIGS. 3 and 4 is illustrated how the relief structure 7 of the game board 2 evolves for example sinusoidally or more or less sinusoidally in the aforesaid directions X-X' and Y-Y', whereby the angle A, enclosed between the line 10 which is tangent to the sinusoidal course and the average surface of the game board 2, is preferably not larger than 45°.

The dips 9 between the rises 8 are connected to one another by means of grooves 11 in the game board 2 which extend in the aforesaid orthogonal directions X-X' and Y-Y'.

The rises 8 are optionally provided with a mark 12 at the top, whereby these marks 12 define the angular points of square virtual play fields 13 as if it were, centred round the dips 9 of the game board 2.

The sliding pieces 3 may have all sorts of shapes.

In the example of FIG. 1 are represented two different sliding pieces 3 which are shown in greater detail in FIGS. 5 to 8, whereby every sliding piece 3 is composed of one or several blocks 14 which are in this case circular and which are mutually connected by means of a fixed connection 15 or a fixed connecting part.

Every block 14 is provided with a contact surface 16 at the bottom with which the block 14 can slide over the game board 2 between successive positions of rest, whereby the block 14 can rest in a dip 9 of the game board 2, whereby said contact surface 16 has a predominantly sloping shape to that end which is mainly complementary to the shape of a dip 9 of the game board 2, save for the grooves, and which thus, in the case of a sinusoidal or more or less sinusoidal course of the relief of the game board 2, has a section which fits in the sinusoidal shape of the game board 2.

On their contact surfaces 16 with the game board 2, the blocks 14 of the sliding pieces 3 are provided with a protrusion 17 which, when the block 14 is moved in one of the orthogonal directions X-X' and Y-Y', is guided in a sliding manner in the aforesaid grooves 11 of the game board 2.

Along the perimeter of the sliding piece 3, the blocks 14 are provided with a collar 18 which is provided with a wavy relief structure 19 at the bottom of the contact surface 16 with the game board 2, which, when the block 14 is in a position of rest in a dip 9 of the game board 2, connects to the shape of the rises 8 of the game board 2 surrounding the dip 9 concerned, which makes it somewhat more difficult for the sliding piece 3 to rotate out of the position of rest, but which does not hinder any sliding according to the orthogonal directions X-X' and Y-Y'.

Both sliding pieces 3A and 3B of FIG. 1 are similar, but the length of the centre distance between the blocks 14 differs.

Figure 5:
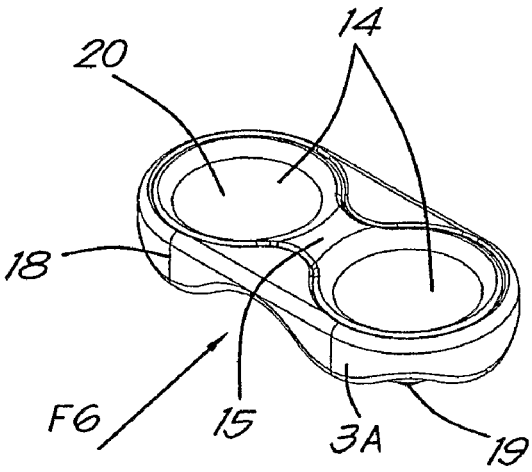
FIG. 5 is a perspective view of the sliding piece indicated by F2 in FIG. 2.
Figure 6:
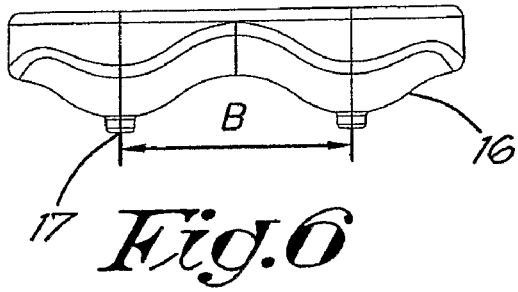
FIG. 6 is a side-view according to arrow F6 in FIG. 5.

In the case of a sliding piece 3A according to FIGS. 5 and 6, said centre distance B between the blocks 14 is equal to the orthogonal centre distance C between two successive dips 9 in any of the aforesaid orthogonal directions X-X' or Y-Y'.

Figure 10:
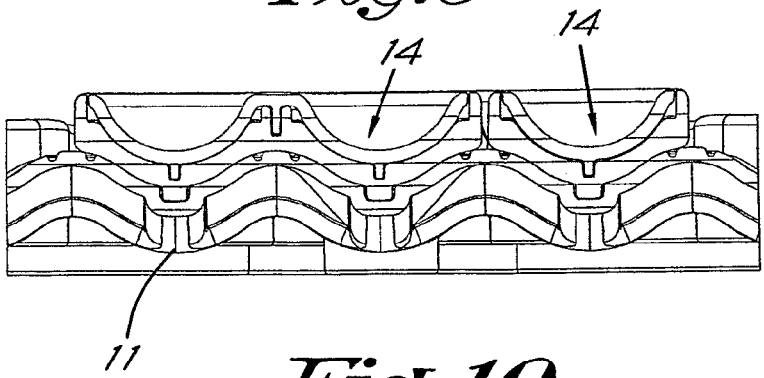
FIGS. 10 and 11 show a section according to lines X-X and XI-XI respectively in FIG. 9, to a larger scale.

When in rest, such sliding pieces 3A extend in the direction of the aforesaid orthogonal directions X-X' or Y-Y', whereby the connection 15 between the blocks 14 does not run over a rise 8, as is shown in the section of FIG. 10.

Figure 7:
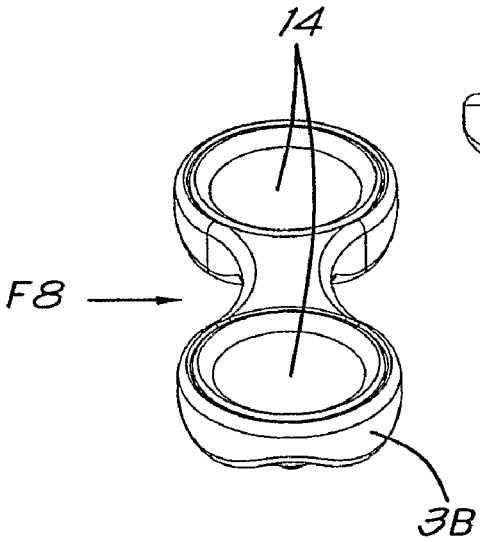
FIG. 7 is a perspective view of the sliding piece indicated by F7 in FIG. 2.
Figure 8:
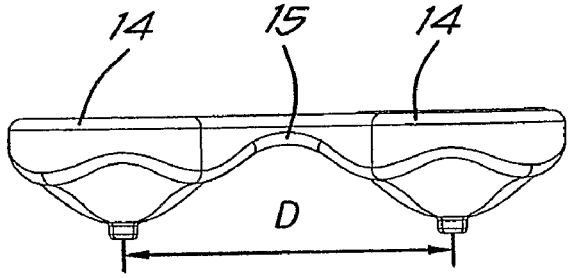
FIG. 8 is a side-view according to arrow F8 in FIG. 7.

In the case of a sliding piece 3B according to FIGS. 7 and 8, said centre distance D between the blocks 14 is equal to the diagonal centre distance E between two successive dips 9 in a diagonal 10 direction 9, which diagonal direction is in this case a direction parallel to the edge 4 of the game board 2.

Figure 11:
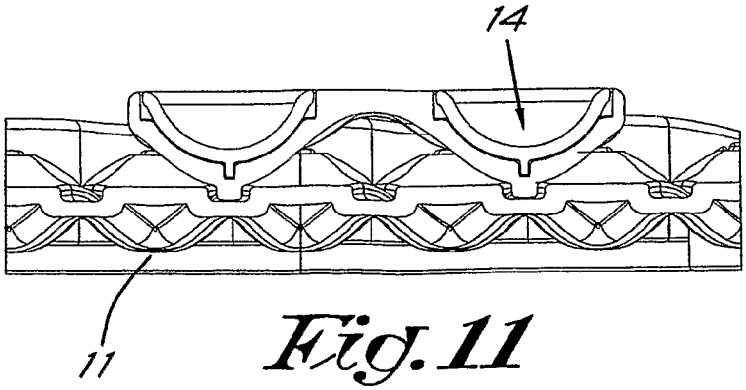

When in rest, such sliding pieces 3B extend in the aforesaid diagonal direction parallel to the edge 4 of the game board 2, whereby the connection between the blocks 14 extends over a rise 8, as shown in the section of FIG. 11.

In the given example, the tops of both sliding pieces 3A and 3B are provided with excavations 20 at the blocks 14 making it possible to move the sliding pieces 3 with one's fingers.

Figure 2:
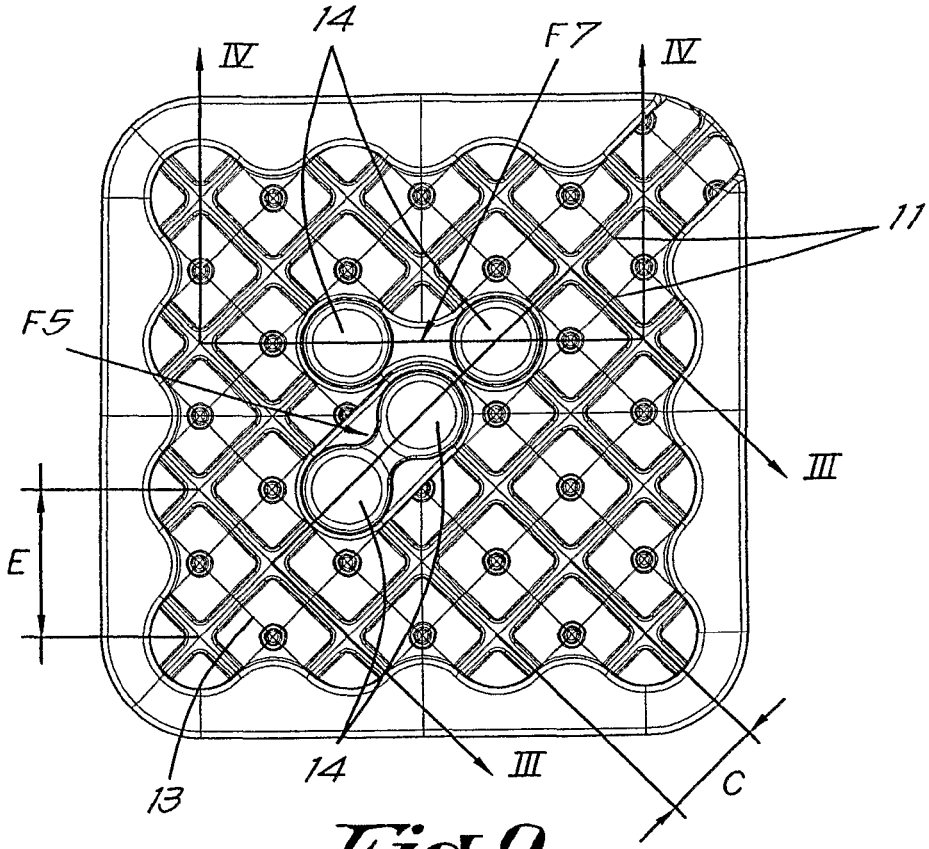
FIG. 2 represents a view from above according to arrow F2 in FIG. 1.

In the case of the sliding piece 3A, the connection 15 between the blocks 14 is a straight piece extending over the entire width of the sliding piece 3A, whereas in the case of the sliding piece 3B, said connection 15 is provided with lateral recesses in view of a lateral connection to the block 14 of an adjoining sliding piece 3B as shown in FIGS. 1 and 2, such that this sliding piece 3B forms a sort of dumb-bell as if it were, with recesses having a curvature radius which is equal to the radius of the circular blocks 14.

Figure 9:
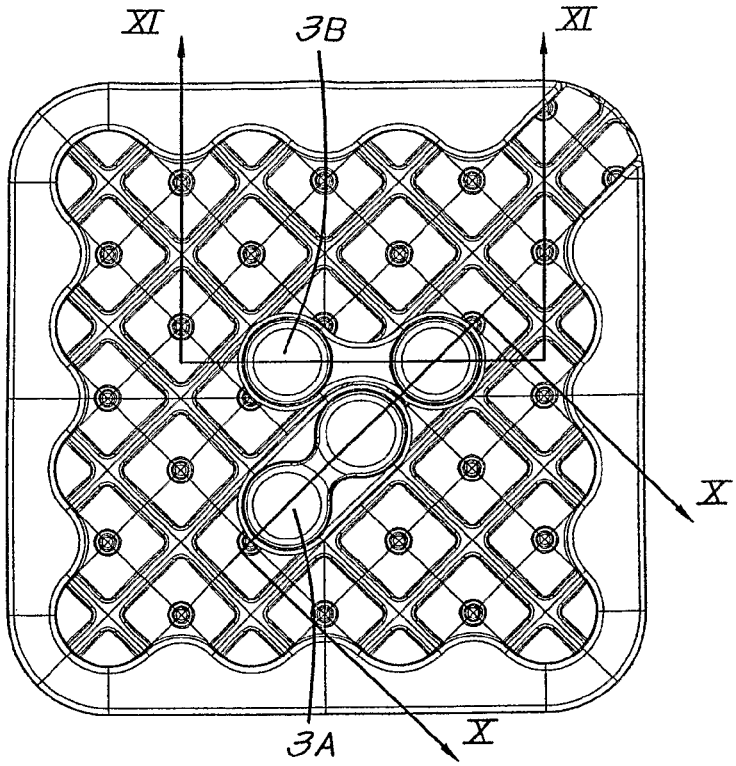
FIG. 9 shows a view as that in FIG. 2, but while the sliding pieces are being moved.

Both types of blocks 14 can only be shifted easily in the directions X-X' and Y-Y', as illustrated by means of FIG. 9, whereby the sliding piece 3A is moved from the position of rest in FIG. 2 towards the edge 4 of the game board 2 in the direction X-X' into a following position of rest whereby the blocks 14 end up in a subsequent series of dips 9.

FIGS. 9 and 10 represent the sliding piece 3A in a position halfway between both positions of rest, whereby due to the wavy structure 7 of the game board 2 the sliding piece 3A is first lifted out of its first position of rest by a lateral movement and, after the top position represented in FIGS. 9 and 10 has been transgressed, then automatically falls in its subsequent position of rest.

FIGS. 9 and 11 illustrate in an analogous way how the sliding piece 3B can be moved in the same direction as the sliding piece 3A, whereby these figures represent the sliding piece 3B in a position halfway between two positions of rest.

It should be noted that, starting from the position of rest in FIG. 2, it is also possible to simultaneously move two or more sliding pieces 3 by moving one of the sliding pieces 3, whereby for example an upward movement of the sliding piece 3A in the direction Y-Y' will move along the sliding piece 3B in the same direction.

Figure 12:
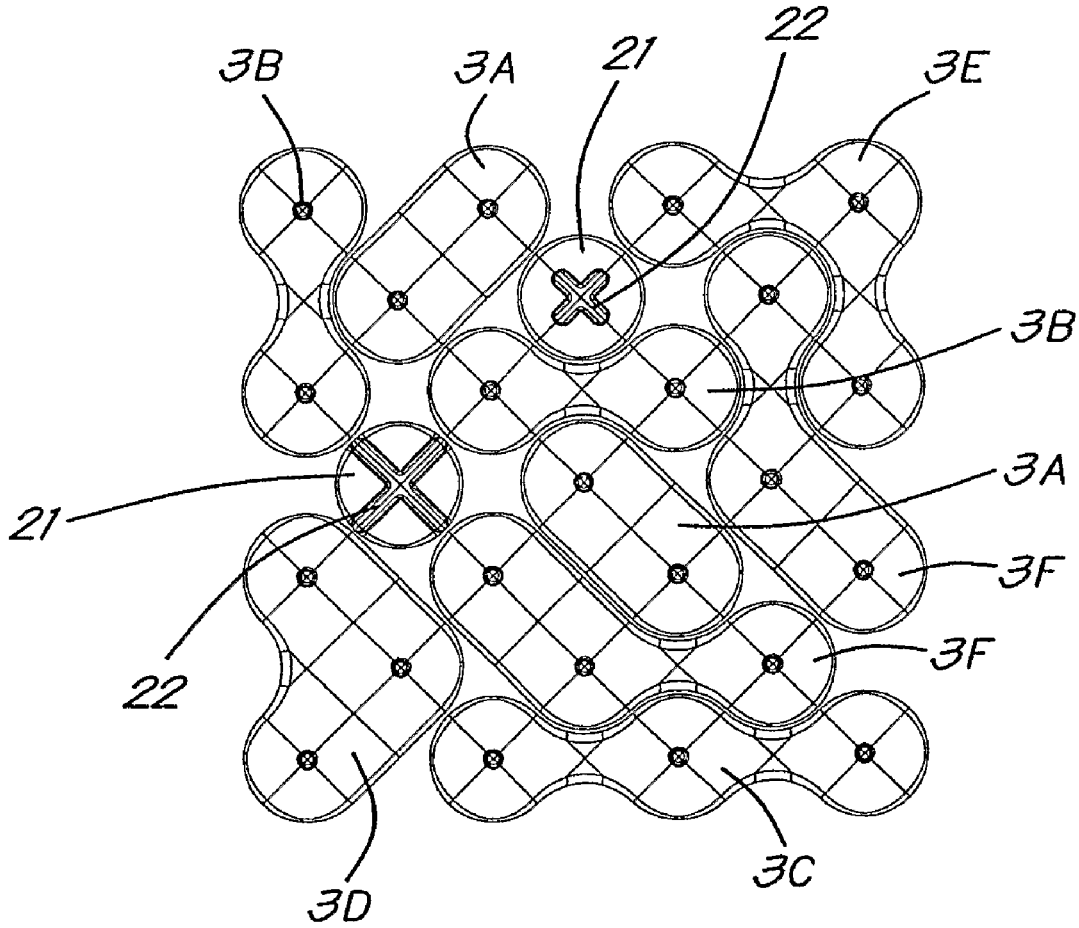
FIG. 12 shows some variants of sliding pieces and other game pieces, seen from underneath.

FIG. 12 represents a series of game pieces, among others a number of sliding pieces 3A and 3B, as well as alternative shapes of sliding pieces 3C respectively in the shape of three blocks which are connected in each other's prolongation, sliding pieces 3D and 3E in the shape of an L-shaped sliding piece with three blocks, or in the shape of a sliding piece 3F with three blocks connected two by two and whose connections enclose an angle of 45° or 135°.

Figure 13:
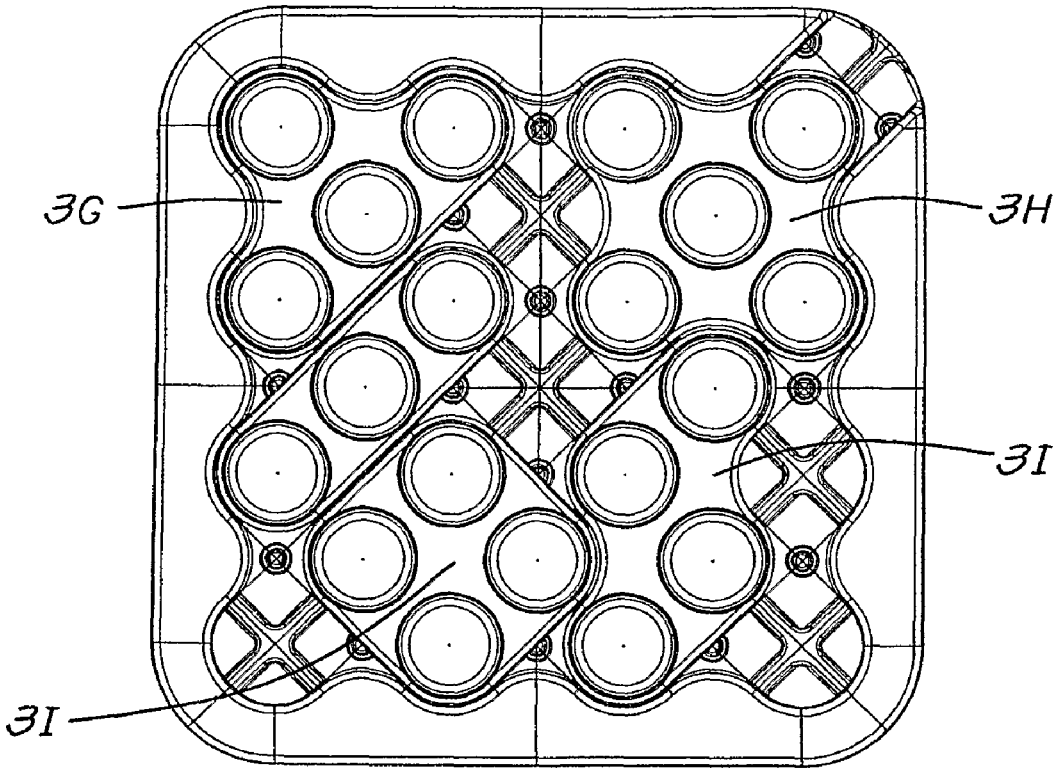
FIGS. 13 and 14 represent examples of a game board with game pieces with alternative embodiments.
Figure 14:
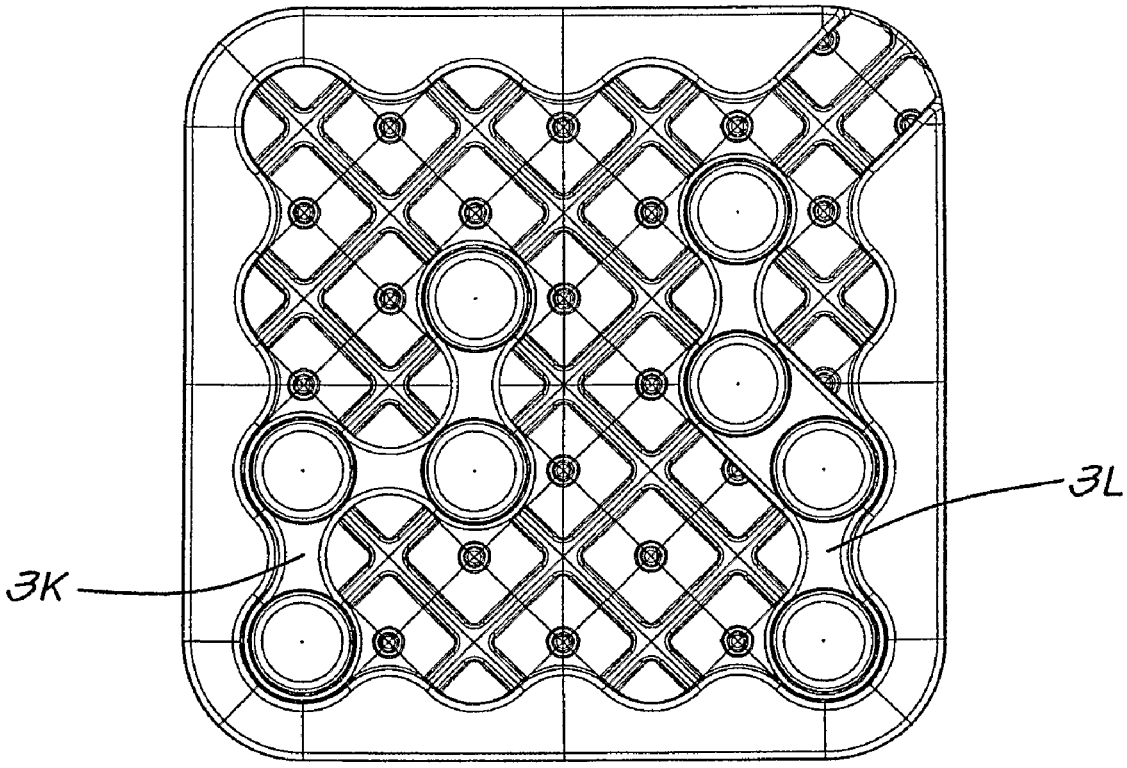

FIGS. 13 and 14 represent some more shapes of sliding pieces 3 with four or more blocks 14, in particular 3G, 3H, 3I, 3J, 3K and 3L.

In general, we can say that in case of sliding pieces 3 with several blocks 14, these blocks 14 are connected in pairs, two by two, whereby the connections between blocks 14 having the same centre distance are at right angles to one another, as is for example the case with the sliding pieces 3D, 3E, 3G, 3K, or are parallel to one another, as is for example the case with the sliding pieces 3C, 3J, 3K and 3L, and the connections between blocks 14 having a different centre distance enclose an angle of 45° or 135°, as is the case with the sliding pieces 3F, 3J and 3L.

FIG. 12 also represents the game pieces in the shape of obstruction pieces 21 which may form a local obstruction to the movement of the sliding pieces 3 and which have a shape consisting of obstruction blocks 14 which is analogous to that of the sliding pieces 3, but whereby at least one obstruction block 14 is either provided with a rib on its contact surface directed towards the game board 2, or with a cross-shaped rib 22 that can be held in two intersecting grooves of the game board 2.

Alternatively, it is also possible to provide sliding pieces whose freedom of movement is hindered in one direction or another as the sliding piece is provided with one or several parallel ribs directed crosswise to the direction in which the sliding movement should be hindered.

The sliding pieces 3 and/or obstruction pieces 21 may have mutually different distinguishing characteristics, such as a difference in colour, texture, shape or the like, and whereby for example the excavations 20 may be replaced by standing figurines or whereby the top side of the sliding piece 3 may be formed as a figurine or an object.

Figure 15:
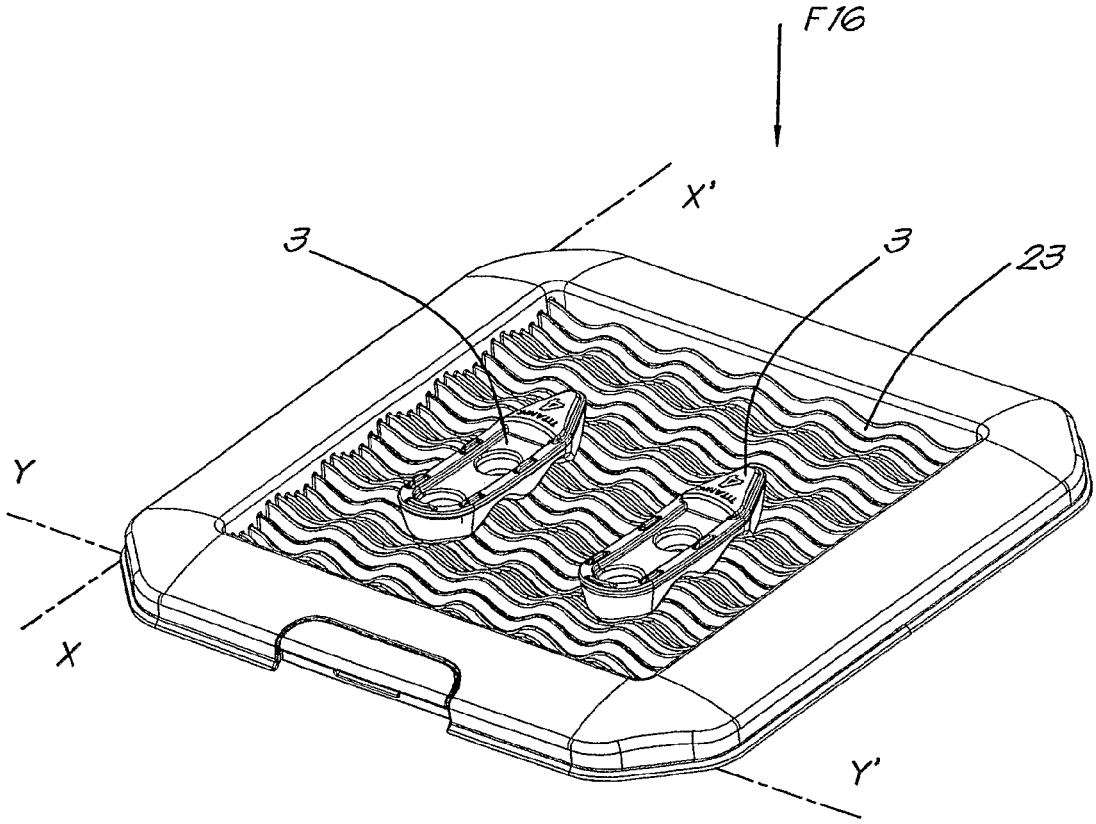
FIG. 15 represents an alternative embodiment of a board game according to the invention.

FIG. 15 represents an example whereby the sliding pieces 3 have the shape of boats, for example, and whereby the game board 2 has a wave structure 7 enabling the boats to slide in two directions parallel to the edges 4 of the game board 2.

Figure 17:
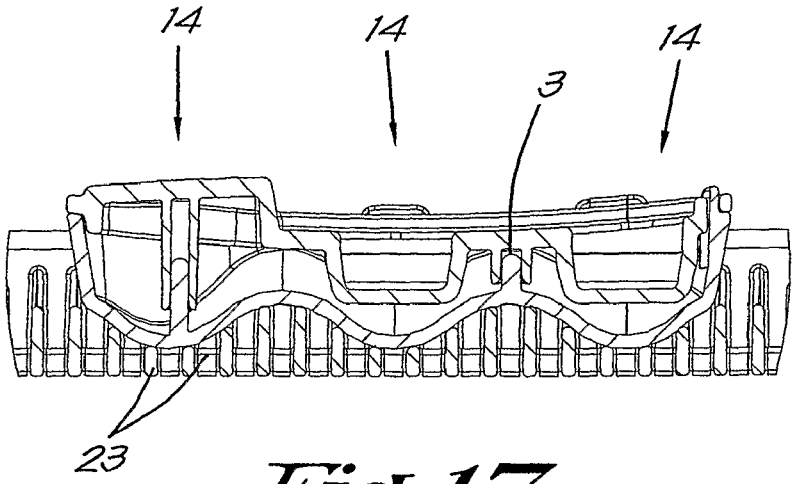
FIG. 17 represents a section according to line XVII-XVII in FIG. 16 to a larger scale.

The shape of the bottom side of the boats thereby fits in the wave structure 7 of the game board 2, as is clear from the detailed FIG. 17.

Figure 16:
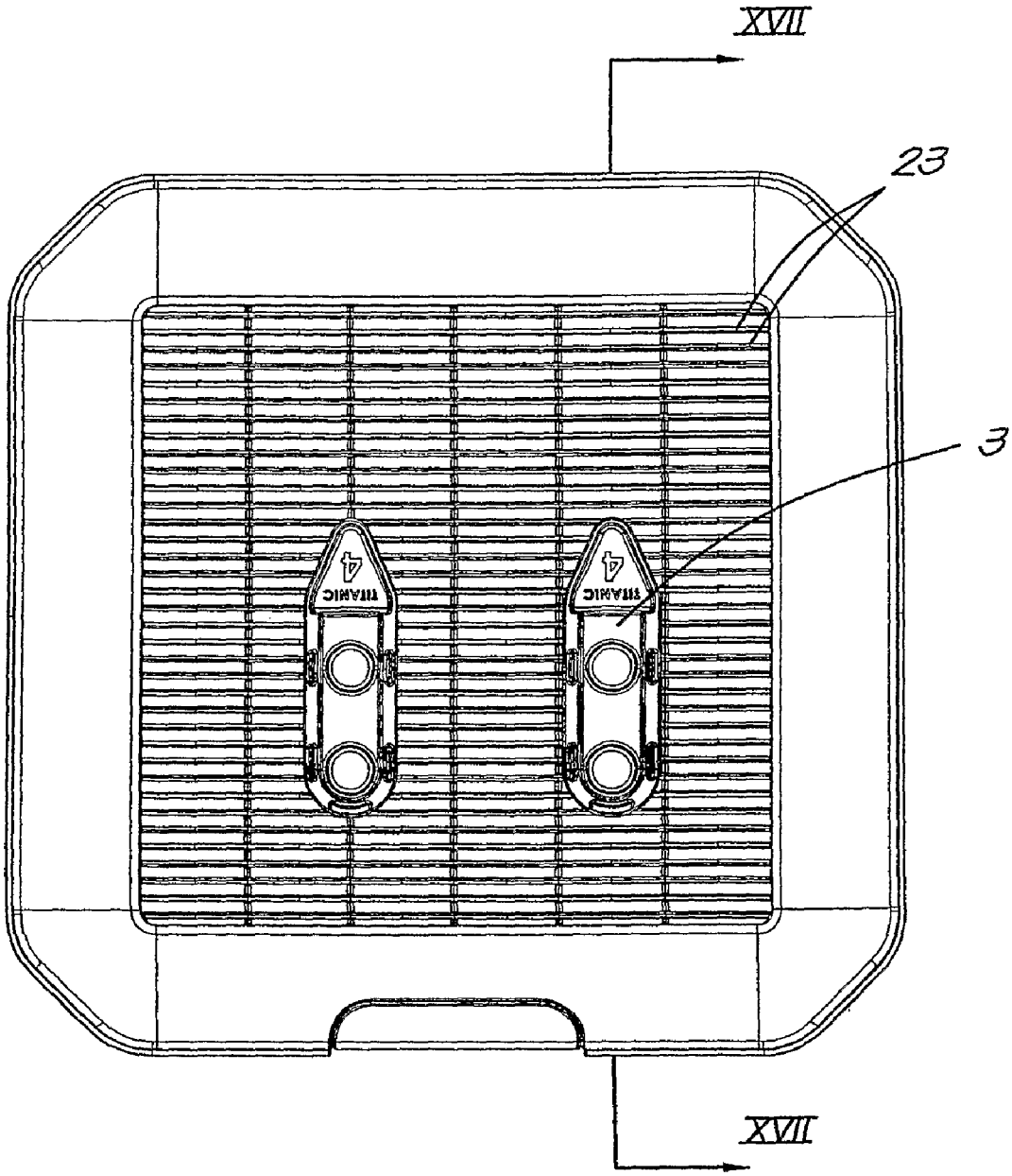
FIG. 16 is a view from above according to arrow F16 in FIG. 12.

Another special characteristic of the game board 2 according to FIG. 16 is that the game board 2 is partly transparent as the relief structure 7 in this case has an open structure of for example parallel beams 23 situated at a distance from one another.

Figure 18:
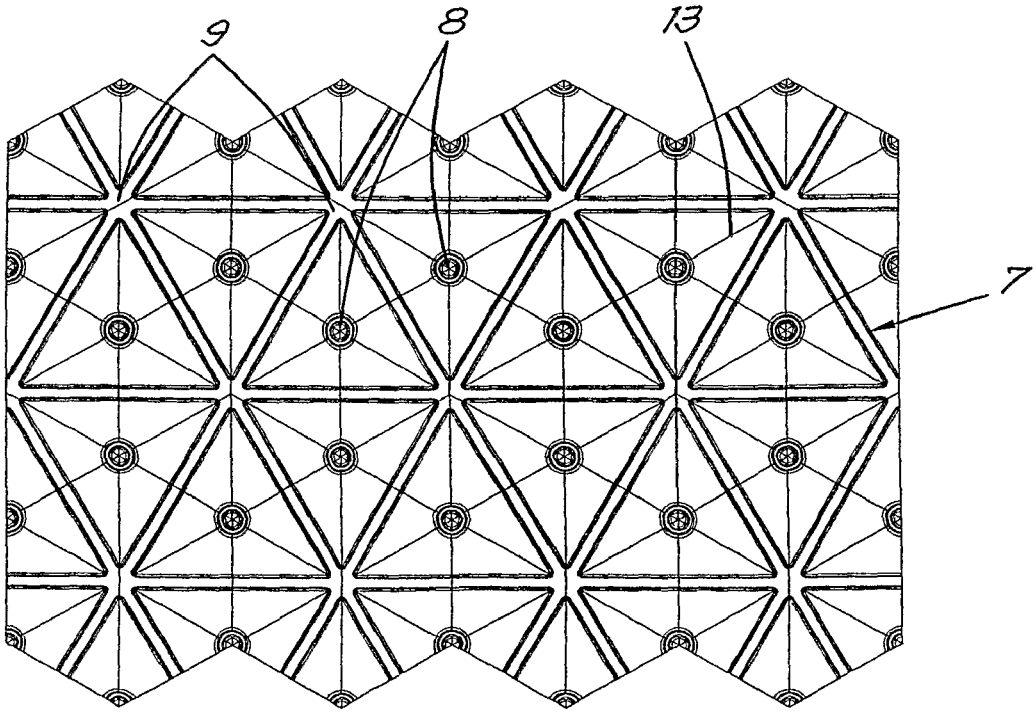
FIG. 18 shows yet another variant of a game board according to the invention.

FIG. 18 represents yet another alternative embodiment of a game board 2 whereby the grid formed of the rises 8 and dips 9 in this case has a relief structure 7 which makes it possible to move the non-represented sliding pieces according to three preferential directions enclosing an angle of 60°, just as the legs of an equilateral triangle.

It should be noted that there is no standing edge along the perimeter of the board in this case, but alternatively it would be possible to nevertheless provide a part of the perimeter with a standing edge.

The present invention is by no means restricted to the embodiments described by way of example and represented in the accompanying drawings; on the contrary, a board game 2 according to the invention can be made in all sorts of shapes and directions while still remaining within the scope of the invention.

The invention claimed is:

1. A game comprising:

a game board having a wavy relief structure formed of a series of alternating rises and dips extending in at least two different directions, wherein the rises and dips are spaced at a regular distance apart from one another; and at least one game piece configured to contact the game board, said at least one game piece comprising at least two blocks, and said at least two blocks being connected to one another;

wherein each block of said at least two blocks has a lower contact surface having a shape which complements the shape of the dips of the game board, wherein said game board and said at least one game piece are configured so that the at least one game piece is manually slidable over the wavy relief structure of the game board between two arbitrary fixed positions of rest between the alternating rises and dips, wherein at least one of said two different directions forms a preferential direction for sliding movement of the game piece, and wherein at every position of rest, each block of the at least one game piece on the board rests in a separate dip of the game board.

2. The game according to claim 1, wherein the relief structure of the game board has a sinusoidal shape or approximately sinusoidal shape in said different directions.

3. The game according to claim 1, wherein at least one block of the at least one game piece comprises a protrusion on said lower contact surface, said protrusion being directed towards the game board, and wherein the game board further comprises continuous grooves extending in the said different directions in the game board and connecting the dips of the game board so as to form a guide for the protrusion.

4. The game according to claim 3, further comprising at least one obstruction piece configured to contact the game board, said at least one obstruction piece forming a local obstacle to a sliding movement of the at least one game piece, said at least obstruction piece comprising at least one obstruction block, said obstruction block having a shape analogous to at least one of said blocks of the at least one game piece, wherein additionally the at least one obstruction piece comprises a contact surface, said contact surface comprising a protruding rib directed towards the game board, wherein said rib is straight or cross-shaped, and wherein said rib fits in a groove or in two crossing grooves of the game board.

5. The game according to claim 1, wherein each block of the at least one game piece is provided with a wavy relief structure along a perimeter of said lower contact surface so that when the block is in a position of rest in a dip of the game board, said perimeter of said lower contact surface is connectable to rises of the game board surrounding the respective dip.

6. The game according to claim 1, wherein the rises of the game board are provided with a mark at a top of each rise.

7. The game according to claim 1, wherein said different directions in which the game pieces can be slid are in two perpendicular orthogonal directions.

8. The game according to claim 7, wherein the blocks of the at least one game piece are connected in such a way that the centre distance between two adjoining blocks is either equal to an orthogonal centre distance between two successive dips in any one of the orthogonal directions, or is equal to a diagonal centre distance between two successive dips in a diagonal direction.

9. The game according to claim 8, wherein the blocks of the at least one game piece are connected two by two, so that the connections between blocks having the same centre distance are parallel or are at right angles to one another, and the connections between blocks having a different centre distance enclose an angle of 45° or 135 °.

10. The game according to claim 8, wherein the connections between blocks situated at a diagonal distance from one another are provided with lateral recesses for a lateral fitting connection to a block of an adjoining game piece.

11. The game according to claim 10, wherein each block has a predominantly circular perimeter defining a circumference, and the recesses in the connections are made according to the segment of a circle having the same radius of curvature as a radius of the circumference of the block.

12. The game according to claim 1, comprising several game pieces connected in a way such that the several game pieces are slidable simultaneously by moving one game piece.

13. The game according to claim 1, comprising several game pieces, wherein said several game pieces comprise two blocks and/or three or more blocks, said blocks being connected together two by two and whose connections are either situated in each other's prolongation or mutually enclose a right angle or an angle of 45° or 135°.

14. The game according to claim 1, comprising multiple game pieces provided with mutually different distinguishing characteristics.

15. The game according to claim 1, wherein the game board is transparent or partly transparent.

16. The game according to claim 15, wherein the relief structure is formed as an open structure.

17. The game according to claim 1, wherein the game board is provided with a standing edge and at least one exit is provided in the edge, wherein said game piece can be slidingly removed from the game board.

18. The game according to claim 17, further comprising an obstruction piece, wherein the standing edge on an inner perimeter of the game board is either smooth or is an edge provided with recesses or waves for fitting a lateral connection of a block of an adjoining game piece or obstruction piece or a combination of both.

19. The game according to claim 1, wherein the game board has a rectangular or square shape and the said different directions in which the at least one game piece can be slid extend diagonally.

20. The game according to claim 1, wherein the the at least one game piece is configured to enable the game piece to slide in only one of the different directions.

21. The game according to claim 1, wherein the different directions extend in three directions according to the directions of legs of an isosceles triangle.

* * * * *